United States Patent [19]

Sensui et al.

[11] 4,148,352

[45] Apr. 10, 1979

[54] METHOD OF PREPARING AN EXHAUST PORT ARRANGEMENT OF A CYLINDER HEAD

[75] Inventors: Kunio Sensui; Yoshimasa Hayashi, both of Yokohama, Japan

[73] Assignee: Nissan Motor Company, Limited, Japan

[21] Appl. No.: 705,443

[22] Filed: Jul. 15, 1976

[30] Foreign Application Priority Data

Aug. 15, 1975 [JP] Japan ..... 50/112930[U]

[51] Int. Cl.[2] ..... B22D 19/00

[52] U.S. Cl. ..... 164/112; 164/98; 164/132; 164/137

[58] Field of Search ..... 164/98, 112, 137, 9, 164/10, 11, 365, 366, 367, 368, 369, 370, 132, 23, 27; 60/282; 249/184

[56] References Cited

U.S. PATENT DOCUMENTS

| | | | |
|---|---|---|---|
| B 499,227 | 1/1976 | Hayes et al. | 164/366 X |
| 2,065,287 | 12/1936 | Nutt | 164/369 X |
| 2,978,764 | 4/1961 | Hrabovsky | 164/9 |

*Primary Examiner*—Richard B. Lazarus
*Assistant Examiner*—Gus T. Hampilos
*Attorney, Agent, or Firm*—Robert E. Burns; Emmanuel J. Lobato; Bruce L. Adams

[57] ABSTRACT

A heat insulation layer is provided on the exterior surface of a port liner. The port liner is installed in the exhaust port passage upon casting of a cylinder head by filling a moulding material in the cavity of the port liner to serve as an exhaust port, mounting preformed and cured separate layers of moulding material on the exterior surface of the port liner and using the port liner with a mass of a moulding material therein and separate layers of a moulding material thereon as a core for casting an exhaust port passage and a heat insulation layer of the exhaust port.

1 Claim, 4 Drawing Figures

METHOD OF PREPARING AN EXHAUST PORT ARRANGEMENT OF A CYLINDER HEAD

BACKGROUND OF THE INVENTION

The present invention relates to a method of producing an exhaust port arrangement of a cylinder head installed with a port liner in its exhaust port passage.

Various techniques have been proposed to reduce air pollutants such as hydrocarbon and carbon monoxide in the exhaust gases emitted from the automobiles. Among such techniques, it has been practiced to mount a thermal reactor and/or a catalyst in the exhaust system of an internal combustion engine. The efficiencies of the thermal reactor and the catalyst depend on the temperature of exhaust gas, so that it is necessary to minimize the heat loss in the exhaust system to maintain the exhaust gas at an elevated temperature.

A conventional internal combustion engine is thus installed with a port liner in an exhaust port passage of a cylinder head upon casting of the cylinder head to form a heat insulation layer on the exterior surface of the port liner. Such method includes the steps of preparing a core comprising an elongate tubular port liner having a cavity to serve as an exhaust port when installed in the exhaust port passage, a mass of moulding sand closely filled in the cavity and an elongate tubular layer of moulding sand formed on the exterior surface of the port liner to form thereon a heat insulation layer.

Such steps, however, have a drawback of poor productivity which is caused by the fact that it needs a considerable time until the mass of green moulding sand cures completely because the mass must be mainly heated through the tubular layer and the port liner and further because the amount of heat supplied to the tubular layer should be maintained under a predetermined level which assures proper curing of the tubular layer.

SUMMARY OF THE INVENTION

It is therefore an object of the present invention to provide a method of producing an exhaust port arrangement of a cylinder head of the type provided with a heat insulation layer on the exterior surface of the port liner, by which the productivity of cylinder heads with an exhaust port arrangement of the foregoing type increases.

BRIEF DESCRIPTION OF THE DRAWINGS

Other objects, features and advantages of the present invention will become apparent from the following description in connection with the accompanying drawings, in which.

DESCRIPTION OF THE PREFERRED EMBODIMENTS

Figure 1:
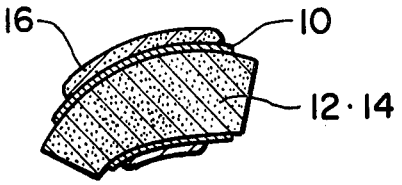
FIG. 1 PRIOR ART
FIG. 1 is a sectional view of a core for an exhaust port passage and a heat insulation layer of an exhaust port prepared by the steps according to the conventional method.

Reference is now made to the drawings, wherein like reference characters designate like or corresponding parts throughout.

The conventional method of producing an exhaust port arrangement of a cylinder head of the type provided with a heat insulation layer on the exterior surface of a port liner which is installed in the exhaust port passage upon casting operation of the cylinder head includes the steps of preparing such core as shown in FIG. 1. The core comprises a port liner 10 made of heat resisting sheet steel and having a cavity or passage 12 to serve as an exhaust port (shown in FIG. 4 as the reference numeral 18 when formed in an exhaust port passage, a mass of moulding sand 14 closely filled in the cavity 12 of the port liner 10 and an elongate tubular layer of moulding sand 16 formed on the exterior surface of the port liner 10 to form thereon a heat insulation layer.

Such core is prepared by the conventional steps as follows. In the first place, a port liner is prepared and green moulding sand is closely filled in the cavity 12 to form a mass of moulding sand 14. Green moulding sand is a mixture of sand grains, clay, water and other materials to improve properties such as hot strength, thermal stability and surface finish. An elongate tubular layer of green moulding sand 16 is then formed on the exterior surface of the port liner 10. The tubular layer 16 and the mass 14 are then cured by heat so as to increase strength thereof.

As indicated hereinbefore according to the present invention, such steps to prepare the core of the above mentioned type has a drawback it needs a considerable time until the mass of green moulding sand 14 cures completely since the mass 14 must be mainly heated through the tubular layer 16 and the port liner 10 and further since the amount of heat supplied to the tubular layer 16 should be maintained at a predetermined level which assures proper curing of the tubular layer 16. A supply of sufficient heat to the mass 14 through the tubular layer 16 and the port liner 10 for rapid curing of the mass 14 will cause the tubular layer 16 to be excessively cured. Such excessive curing of the tubular layer 16 may deteriorate the properties of the tubular layer 16 such as strength against external force. In case of employing incompletely cured cores upon casting of cylinder heads, the rate of producing cylinder heads of defective quality may considerably increase.

To solve such drawback in the conventional method, according to the present invention a method is provided of producing an exhaust port arrangement of the foregoing type which includes novel steps of preparing a core used upon casting of a cylinder head.

Figure 2:
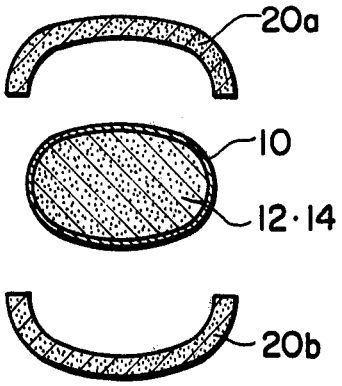
FIG. 2 is an illustrative sectional view of a core for an exhaust port passage and a heat insulation layer of an exhaust port prepared by the steps according to the present invention.
Figure 3:
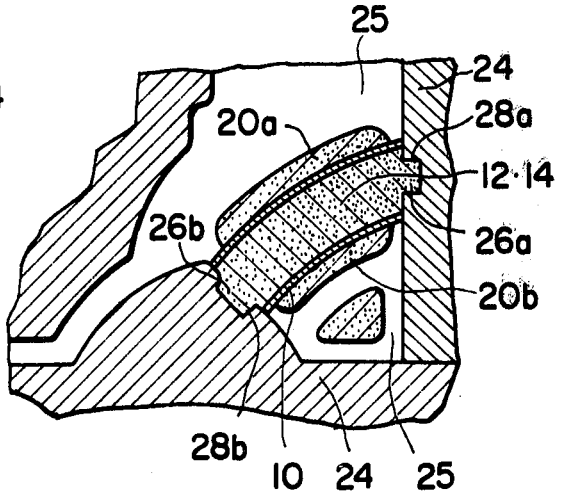
FIG. 3 is a fragmentary schematic sectional view of a mould for casting a cylinder head assembled with a core which is prepared by the steps according to the present invention.
Figure 4:
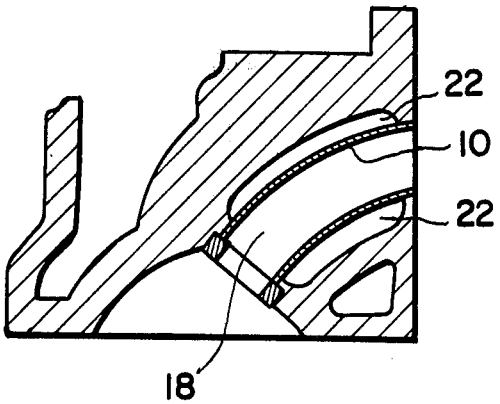
FIG. 4 is a fragmentary schematic sectional view of a cylinder head having an exhaust port arrangement formed with a port liner with a heat insulation layer in the exhaust port passage by the method according to the present invention.

Referring to FIGS. 2, 3, and 4, the method of producing an exhaust port arrangement of a cylinder head according to the present invention will be explained hereinafter. As a first step, a port liner 10 made of heat resisting sheet steel and having a cavity 12 to serve as an exhaust port 18 when installed in an exhaust port passage of a cylinder head is prepared. A moulding material, which is curable by heat and preferably green moulding sand, is closely filled in the cavity 12 of the port liner 10 to form a mass of the moulding material 14. The mass of the moulding material 14 is then heated by sufficient heat applied mainly through the port liner 10 until the mass 14 cures completely. While the process of preparing the port liner 10 with the completely cured mass 14 therein is proceeding, at least two individual layer members or elongate arcuate cross-section layers 20*a* and 20*b* of a moulding material, which is curable by heat and peferably green moulding sand, are prepared independently of the process of preparing the port liner 10 with the completely cured mass 14 therein. The layer 20*a* and 20*b* are so shaped as to be assembled into an elongate tubular layer which corresponds in shape to a heat insulation layer 22 to be formed on the port liner 10. The layers 20*a* and 20*b* are then heated until cured completely.

When the port liner 10 with the completely cured mass of the moulding material 14 and the preformed and completely cured layers of the moulding material 20*a* and 20*b* have been prepared, the layers 20*a* and 20*b* are mounted on the exterior surface of the port liner 10 at a desired position and preferably bonded thereon. Then the port liner 10 with the layers 20*a* and 20*b* and the mass 14 is positioned into a mould 24 for casting a cylinder head in a manner to form a space 25 between the mould 24 and the peripheral surfaces of the port liner 10 and the layers 20*a* and 20*b*.

As shown in FIG. 3, the mass 14 may be provided at each axial end of the port liner 10 with a boss 26*a* and 26*b*, which respectively project into each of corresponding recesses 28*a* and 28*b* provided in the mould 24 so as to support the port liner 10 firmly.

Molten metal is prepared according to the conventional method and poured into the space 25 to cast an exhaust port arrangement of a cylinder head. After the molten metal has solidified, the mass of the moulding material 14 and the layers of the moulding material 20*a* and 20*b* are removed from the casting of the cylinder head to provide the cylinder head with an exhaust port 18 and a heat insulation layer of air 22. If it is difficult to remove the layers of the moulding material 20*a* and 20*b* therefrom, the layers 20*a* and 20*b* may be left thereat to form a heat insulation layer of the moulding material on the exterior surface of the port liner 10.

From the foregoing description, it will be understood that according to the method of the present invention the mass of the moulding material 14 can be cured by heat only through the port liner 10 so that the sufficient amount of heat may be available to cure the mass 14 rapidly and properly.

It will be further understood that the layers 20*a* and 20*b* and the port liner 10 with the mass 14 therein can be prepared independently from each other so that the time necessary to finish the method of producing an exhaust port arrangement is considerably shortened.

It will be still further understood that complete curing of the layers 20*a* and 20*b* and the mass 14 may be increasingly assured according to the present invention so that the quality of an exhaust port arrangement in a cylinder head may be considerably improved.

While the tubular layer of the moulding material assembled on the exterior surface of the port liner 10 has thus far been described and shown as it is separated into two pieces 20*a* and 20*b* according to the present invention, the tubular layer may be further divided into pieces more than two, if desired.

It is desirable to form the inner configuration of each of the layers 20*a* and 20*b* so as to precisely fit on the corresponding exterior surface of the port liner 10, however such is not essential. Because the difference in shape between the corresponding surfaces of the layers 20*a* and 20*b* and the port liner 10 may cause some cracks in the layers 20*a* and 20*b* when they are forcibly pressed against the exterior surface of the port liner 10 when mounted thereon, however such cracks do not cause any harm on proceeding with the method of the present invention nor defective quality to a product of an exhaust port arrangement of a cylinder head.

What is claimed is:

1. A method of producing an exhaust port arrangement of a cylinder head of the type provided with a heat insulation layer on the exterior surface of a port liner which is installed in an exhaust port passage of a cylinder head upon casting of the cylinder head, comprising the steps of:

preparing a port liner made of a heat resisting steel and having a passage to function in use as an exhaust port;

completely filling the passage of said port liner with a moulding material curable by heat;

heating mainly through said port liner said mass in the passage until cured;

preforming two individual layer members made of a moulding material curable by heat and shaped to be assembled into an elongate tubular layer of lesser axial length than said port liner and which corresponds in shape with and defines a heat insulation layer to be formed on the exterior surface of the port liner, said layer members when assembled defining two parting lines of said tubular layer and extending longitudinally of said tubular layer;

heating said individual layer members until cured;

mounting circumferentially on the exterior surface of said port liner with said mass cured therein said individual layer members cured to form at a desired axial position on said port liner said elongate tubular layer as a heat insulation layer, of lesser axial length than the port liner;

bonding said individual layer members on said port liner;

positioning said port liner with said tubular layer thereon and said mass therein into a mould for casting a cylinder head; and casting a cylinder head in said mold with said exhaust port liner and said tubular thereon in said cylinder head with said port liner fixed thereto.

* * * * *